United States Patent [19]

Forney, Jr. et al.

[11] Patent Number: 4,619,496

[45] Date of Patent: Oct. 28, 1986

[54] COAXIAL PLUG AND JACK CONNECTORS

[75] Inventors: Edgar W. Forney, Jr.; George W. Michael, III, both of Harrisburg, Pa.

[73] Assignee: AMP Incorporated, Harrisburg, Pa.

[21] Appl. No.: 650,575

[22] Filed: Sep. 14, 1984

Related U.S. Application Data

[63] Continuation of Ser. No. 489,995, Apr. 29, 1983, abandoned.

[51] Int. Cl.[4] ..... H01R 17/18

[52] U.S. Cl. ..... 339/177 R; 339/276 R; 339/95 A; 339/91 R

[58] Field of Search ..... 339/177, 95, 252–258, 339/91 R, 91 P, 276 R

[56] References Cited

U.S. PATENT DOCUMENTS

| | | | |
|---|---|---|---|
| 2,981,924 | 4/1961 | DuPree | 339/259 R |
| 2,990,533 | 6/1961 | Hughes et al. | 339/95 A |
| 3,093,887 | 6/1963 | Prestige et al. | 339/95 R |
| 3,208,033 | 9/1965 | Blonder | 339/177 R |
| 3,227,993 | 1/1966 | Bentley | 339/177 R |
| 3,302,159 | 1/1967 | Schumacher | 339/177 R |
| 3,525,973 | 8/1970 | Kipnes | 339/177 R |
| 3,613,050 | 10/1971 | Andrews | 339/177 R |
| 3,745,514 | 7/1973 | Brishka | 339/91 R |
| 3,781,763 | 12/1973 | Feeser et al. | 339/91 P |
| 3,792,418 | 2/1974 | Kailus | 339/177 R |
| 3,871,735 | 3/1975 | Herrmann | 339/177 R |
| 3,923,367 | 12/1975 | Carter | 339/177 R |
| 4,017,139 | 4/1977 | Nelson | 339/91 R |
| 4,072,386 | 2/1978 | Wallo | 339/177 R |
| 4,307,926 | 12/1981 | Smith | 339/177 R |
| 4,360,244 | 11/1982 | Forney et al. | 339/177 R |
| 4,377,320 | 3/1983 | Lathrop et al. | 339/177 R |
| 4,412,717 | 11/1983 | Monroe | 339/177 R |
| 4,445,745 | 5/1984 | Cartesse | 339/177 R |
| 4,447,107 | 5/1984 | Major et al. | 339/177 E |
| 4,453,796 | 6/1984 | Monroe | 339/177 R |

*Primary Examiner*—Gil Weidenfeld
*Assistant Examiner*—David L. Pirlot

[57] ABSTRACT

A coaxial connector includes matable plug and jack connector members with the plug connector member including inner and outer shell members crimpably secured together along small diameter sections thereof to electrically connect an outer conductor of a coaxial cable therebetween while the center conductor of the cable is crimpably connected to a center contact member secured in a dielectric member within a large diameter section of the inner shell member. A hood section of the outer shell member includes an internal latching groove that matably connects with radiussed projections of spring contact members of a jack connector member when the plug connector member electrically mates with the jack connector member with center contact members of the plug and jack connector members electrically connecting with one another.

5 Claims, 11 Drawing Figures

Fig. 7
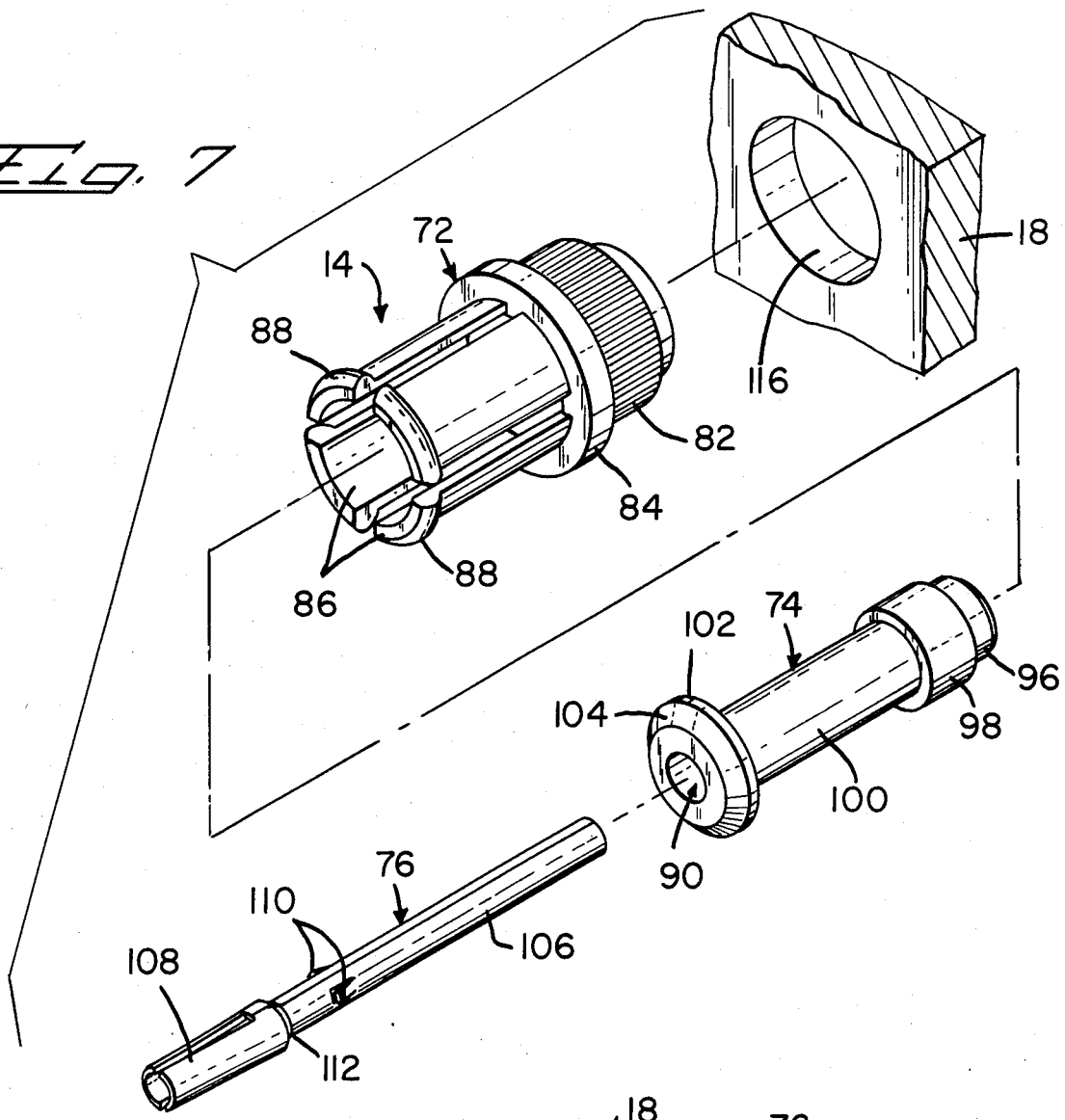
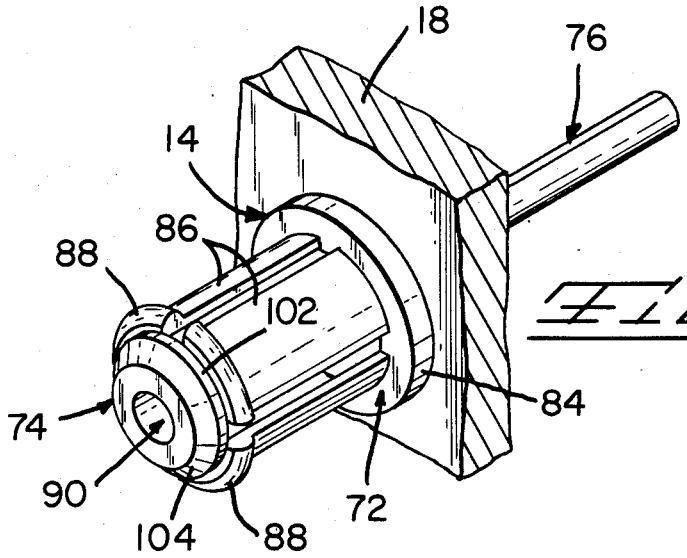
Fig. 8

COAXIAL PLUG AND JACK CONNECTORS

This application is a continuation of application Ser. No. 489,995 filed Apr. 29, 1983 now abandoned.

FIELD OF THE INVENTION

This invention relates to electrical connectors and more particularly to coaxial plug and jack connectors.

BACKGROUND OF THE INVENTION

Miniature coaxial connectors terminated to small diameter coaxial cables are being used to interconnect electronic equipment. The coaxial connector disclosed in U.S. Pat. No. 4,377,320 is such a connector, but it is not suitable for high frequency RF applications where space requirements exist because of its large diameter front end which prevents it being used and because the contact between outer contact members has a long path due to the spring contact which renders it unsuitable for high frequency applications.

Another miniature coaxial connector in U.S. Pat. Nos. 3,745,514 and 4,017,139 discloses a complicated structure to achieve a positive connection between matable male and female members. Many parts are needed in these connectors to make the positive connection between the matable members and this results in higher priced connectors.

SUMMARY OF THE INVENTION

According to the present invention, a coaxial connector includes matable plug and jack connector members. The plug connector member includes an inner shell member, an outer shell member, and a dielectric member carrying a center contact member secured in a large diameter section of the inner shell member. A small diameter section of the inner shell member receives an exposed end of an outer conductor of a coaxial cable therealong while an insulation sheath surrounding a center conductor of the coaxial cable is disposed within the small diameter section with an exposed end of the center conductor disposed within the center contact member and crimped thereto. The outer shell member has a smaller diameter section coaxially disposable over the small diameter section of the inner shell member with the exposed outer conductor end therebetween whereafter the smaller diameter section of the outer shell member is crimped onto the small diameter section of the inner shell member connecting the outer conductor therebetween. A larger diameter section of the outer shell member extends coaxially along the large diameter section of the inner shell member and includes a hood section coaxially positioned with respect to a contact pin section of the center contact member that extends outwardly beyond front ends of the dielectric and inner shell members. The hood section has an internal latching groove.

The jack connector member includes a shell member in which is secured a dielectric member carrying a center contact member having a receptable contact section. A securing section of the shell member secures the jack connector member to a ground plane and spring contact members extend outwardly from the shell member and is spaced from and coaxial with respect to the dielectric member as they extend therealong. When matably engaged, the center contact member of the plug connector member extends along a bore in the dielectric member so that the pin contact section matably connects with the receptacle contact section and radiussed projections of the spring contact members of the jack connector member are disposed within the internal latching groove of the hood section of the plug connector member.

BRIEF DESCRIPTION OF THE DRAWINGS

FIG. 7 is a perspective exploded view of components to form a jack connector member.

FIG. 8 is a perspective view of the jack connector member in an assembled condition.

DETAILED DESCRIPTION OF THE INVENTION

Figure 1:
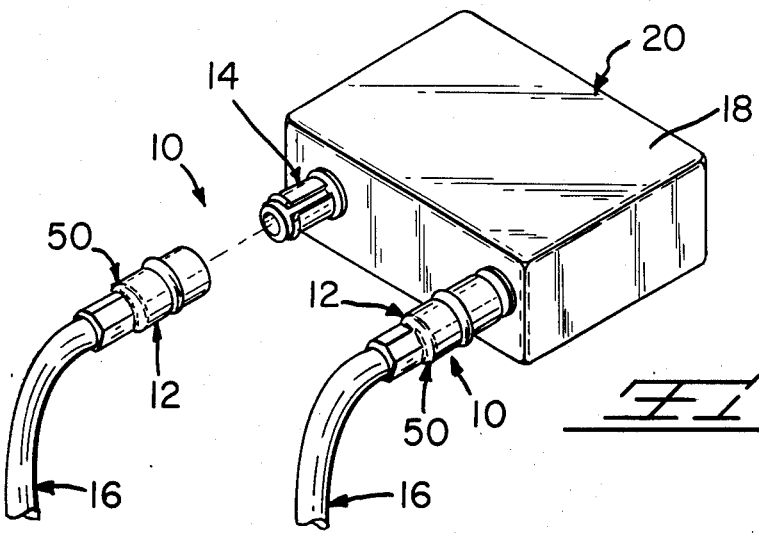
FIG. 1 is a perspective view of an electronic module having jack connector members connected thereto and plug connector members terminated to coaxial cables; one plug connector is connected to the jack connector while the other plug connector is disconnected from the jack connector.
Figures 9, 10, 11:
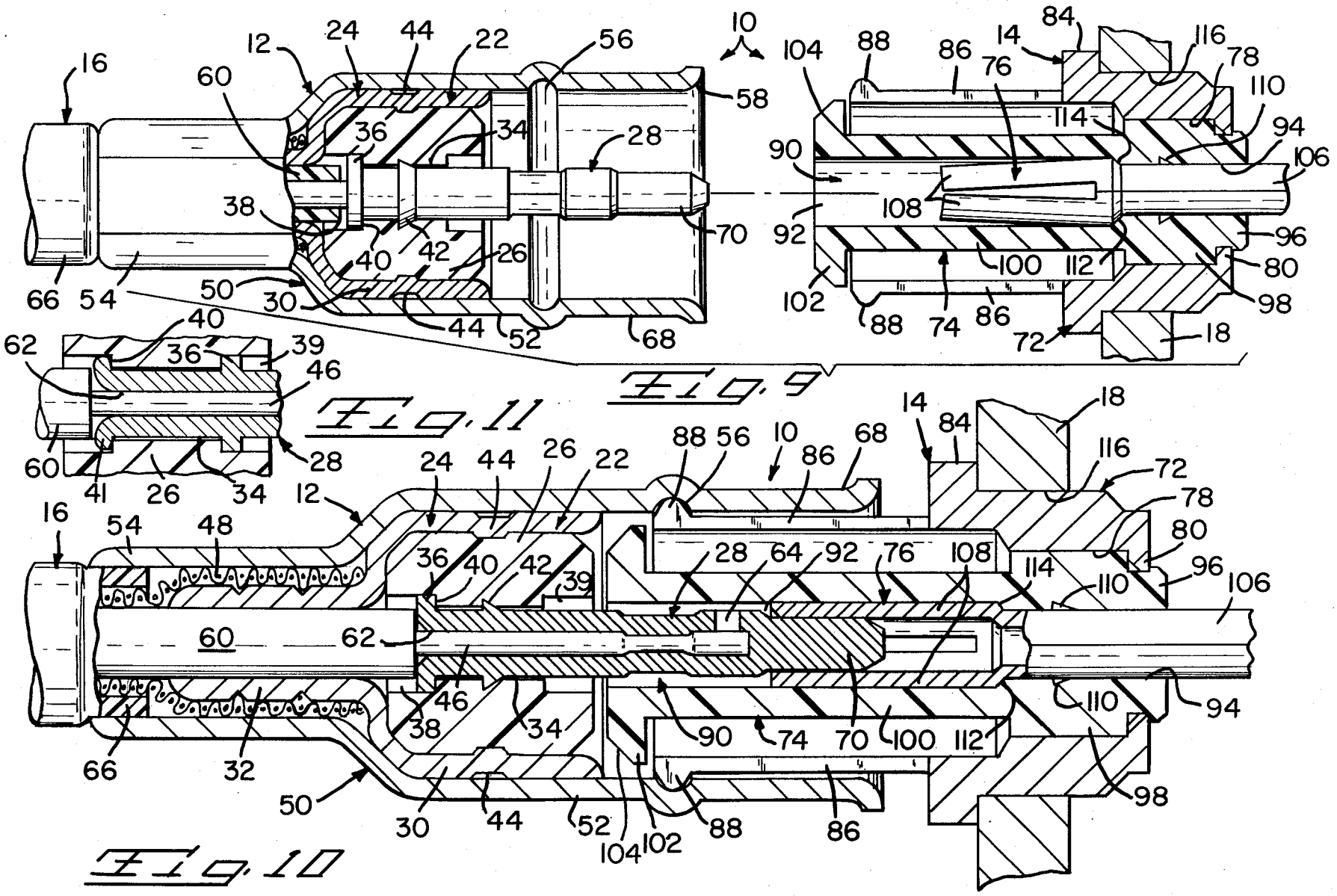
FIGS. 9 and 10 are cross-sectional views of the plug and jack connector members prior to and in matable engagement.
FIG. 11 is a part cross-sectional view showing an alternative embodiment.

Coaxial connector 10 of the present invention as shown in FIGS. 1, 9, and 10 includes a plug connector member 12 as shown in FIGS. 1, 6, 9, and 10, and a jack connector member 14 as shown in FIGS. 1, 8, 9, and 10. Coaxial connector 10 is used to terminate miniature coaxial cable 16 via plug connector member 12 which is then matably connectable with jack connector member 14 mounted onto a metal can 18 of an electronic module 20. The electronic module 20 typically contains microstrip circuitry on a substrate which is grounded to metal can 18, with a center contact of jack connector 14 electrically connected to a signal path of the substrate.

Figure 2:
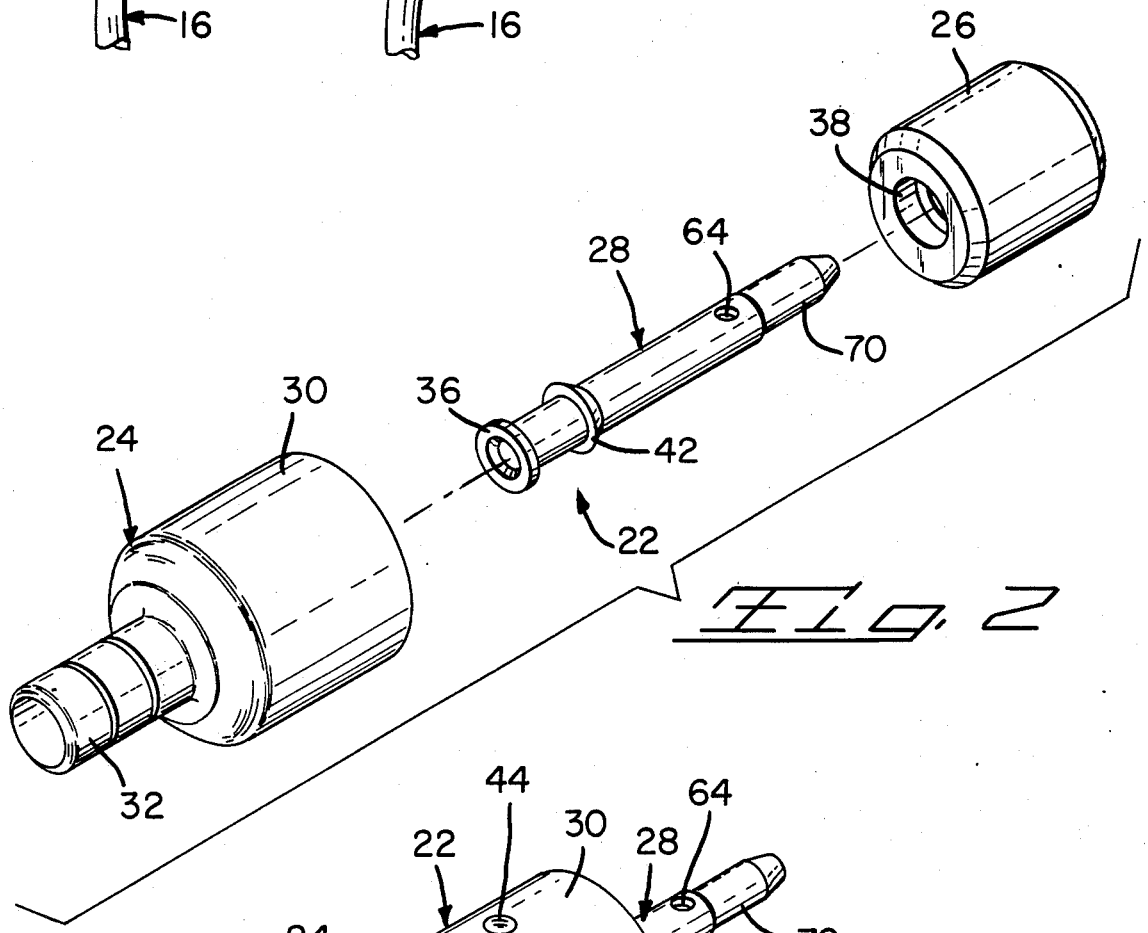
FIG. 2 is an exploded perspective view of components to form a contact assembly of the plug connector member.
Figure 3:
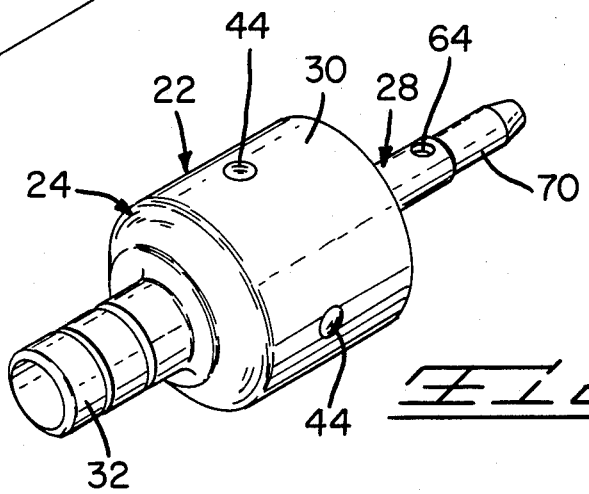
FIG. 3 is a perspective view of the contact assembly of FIG. 2 in an assembled condition.
Figures 4, 5, 6:
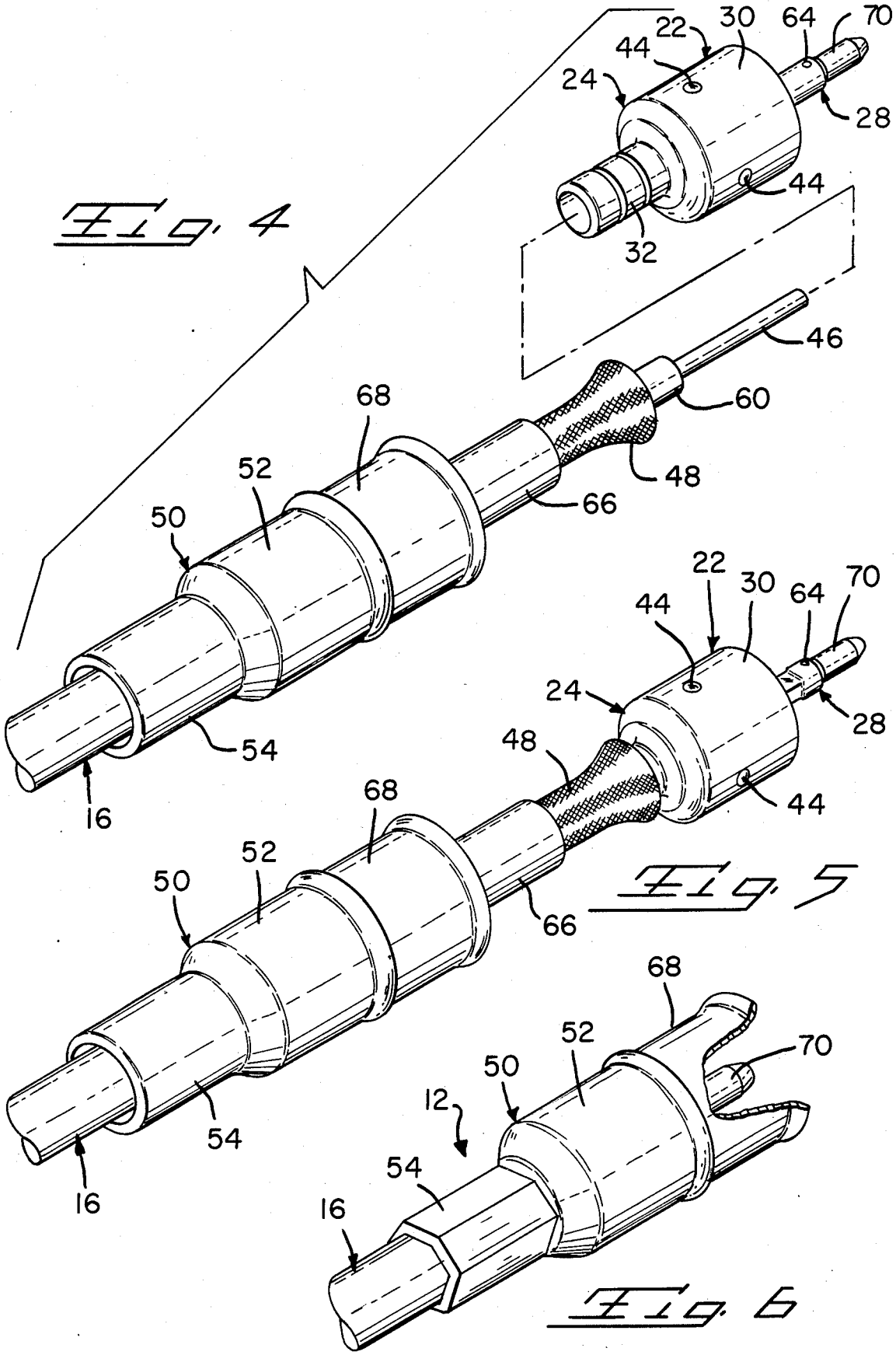
FIGS. 4 through 6 illustrate the termination of a plug connector member to a stripped end of a coaxial cable.

FIGS. 2 through 6 are directed to plug connector member 12 and the termination thereto onto coaxial cable 16. As shown in FIGS. 2 and 3, a contact assembly 22 includes an inner shell member 24, a dielectric member 26, and a center contact member 28. Inner shell member 24 is a drawn metal part which has a large diameter section 30 and a small diameter section 32. Dielectric member 26 is molded or machined from a suitable plastic material and has a profiled bore 34 extending therethrough in which center contact member 28 is disposed with annular flange 36 of center contact member 28 being disposed in an enlarged outer end 38 of profiled bore 34 against stop surface 40 with tapered annular barb 42 biting into the material of dielectric member 26 thereby securing center contact member 28 in position in bore 34 of dielectric member 26 as shown in FIGS. 9 and 10. Alternatively, as shown in FIG. 11, flange 36 can be located toward the front end of center contact member 28 and the back end 41 of contact member 28 can be flared enabling center contact 28 to be forced into bore 34 with flange 36 disposed against the surface in enlarged front end 39 of bore 34 and the flared end disposed within enlarged end 38. This arrangement would not use barb 42. After center contact member 28 has been secured in position in bore 34 of dielectric member 26, this assembly is then inserted into large diameter section 30 of inner shell member 24 and is secured therein by spaced detents 44 formed in large diameter section 30 which are depressed into dielectric member 26 as show in FIGS. 9 and 10. This then forms center and outer contact assembly 22 which is ready to be terminated onto exposed ends of a center conductor 46 and outer conductor 48 of a stripped end of coaxial cable 16 as shown in FIGS. 4 and 5.

Outer shell member 50 is a drawn part and includes a larger diameter section 52 and smaller diameter section 54. An internal annular groove 56 is located in larger diameter section 52 and a bell mouth 58 is located at the forward end of larger diameter section 52.

In assembly as shown in FIGS. 4 through 6, outer shell member 50 is positioned onto miniature coaxial cable 16, exposed center conductor 46 and insulation sheath 60 surrounding center conductor 46 are disposed within center and outer contact assembly 22 with center conductor 46 being positioned within a bore 62 of center contact member 28, insulation sheath 60 being disposed within small diameter section 32 and exposed outer conductor 48 is disposed onto small diameter section 32. An inspection hole 64 is located in center contact member 28 to make certain that center conductor 46 is properly disposed within bore 62 whereafter a crimping tool (not shown) is used to crimp center contact member 28 onto center conductor 46. Outer shell member 50 is then moved along cable 16 into engagement with inner shell member 24 with larger diameter section 52 engaging large diameter section 30 and extending therealong, smaller diameter section 54 extending along small diameter section 32 and outer conductor 48 thereon with the outer end of smaller diameter section 54 extending along a stripped end of outer insulating jacket 66. The crimping tool is then used to center and position center and outer contact assembly 22 with respect to outer shell member 50 whereafter smaller diameter section 54 is crimped onto small diameter section 32 thereby electrically and mechanically connecting outer conductor 48 therebetween, the crimp configuration being of the hexagonal configuration but it can take other forms as desired. The part of smaller diameter section 54 engaging outer insulating jacket 66 as shown in FIG. 10 provides a strain relief for cable 16. Outer shell member 50 electrically connected to inner shell member 24 defines an outer contact member of plug connector member 12 and the section of larger diameter section 52 of outer shell member 50 containing internal annular groove 56 and bell mouth 58 is a hood section 68 that is spaced from and extends coaxially with respect to center contact member 28. The front end of center contact member 28 has a pin contact section 70.

FIGS. 7 through 10 illustrate jack connector member 14 which includes a shell member 72, a dielectric member 74, and a center contact member 76. Metal shell member 72 has a bore 78 which terminates at an inwardly-directly annular flange 80. Serrations 82 extend along an exterior surface of shell member 72 from outwardly-directed annular flange 84. Arcuate-shaped spring contact members 86 extend outwardly from flange 84 coaxial with respect to bore 78. Outwardly-directed radiussed projections 88 are located at the free ends of spring contact members 86.

Dielectric member 74 is molded or machined from a suitable plastic material and has a bore 90 extending therethrough which includes a first section 92 and a second section 94 which is of smaller diameter than first section 92. Dielectric member 74 is formed so as to have a first tubular section 96, a second tubular section 98, a third tubular section 100, and an annular flange 102 at the front end. First and third tubular sections 96 and 100 have substantially the same diameter which is smaller than the diameter of second tubular section 98 while annular flange 102 has a tapered surface 104.

Center contact member 76 is a stamped and formed member from a suitable metal and includes a tubular section 106 extending through second section 94 of bore 90 and arcuate-shaped contact sections 108 disposed within first section 92 of bore 90. Forwardly-directed lances 110 in tubular section 106 bite into the material of dielectric member 74 when center contact member 76 is inserted into bore 90 thereby preventing center contact member 76 from being pushed out of the front end of dielectric member 74 and a transition section 112 of center contact member 76 engages a stop surface 114 in bore 90 limiting the movement of center contact member 76 within bore 90.

With center contact member 76 secured in bore 90 of dielectric member 74, this assembly is then inserted into bore 78 of shell member 72 with second tubular section 98 being disposed in bore 78 against annular flange 80 and first tubular section 96 is forcefully pushed through the opening extending through flange 80 thereby deforming tubular section 96 by forming an annular groove therein and securing dielectric member 74 in position in shell member 72 as illustrated in FIGS. 9 and 10 thereby completing the assembly of jack connector member 14. As can be discerned, spring contact members 86 extend outwardly from tubular section 100 of dielectric member 74 so as to be movable toward tubular section 100 when mated with plug connector member 12. Annular flange 102 protects radiussed projections 88 of spring contact members 86 and tapered surface 104 serves as a guide to guide plug connector member 12 in matable engagement with jack connector member 14.

Jack connector member 14 is inserted into hole 116 in metal can 18 with serrations 82 biting into the metal to mechanically and electrically connect shell member 72 to the metal can, flange 84 limiting the movement of shell member 72 into hole 116. Tubular section 106 of center contact member 76 is electrically connected to signal paths or conductors of the circuitry on the substrate in metal can 18 and jack connector member 14 is now ready to be electrically connected with plug connector member 12. Hood section 68 moves along radiussed projections 88 of spring contact members 86 causing them to be biased inwardly towards tubular section 100 while center contact member 28 moves along bore 90 of dielectric member 74 with pin contact section 70 electrically mating with spring contact sections 108 and radiussed projections 88 coming to rest in internal latching annular groove 56 thereby electrically connecting the outer contact members of plug connector member 12 and jack connector member 14 represented by hood section 68 of outer shell member 50 and spring contact members 86 of shell member 72 while center contact members 28 and 76 are electrically connected via pin contact section 70 and contact sections 108. The conductive paths between outer contact members 50 and 72 is short because of the contact being made by radiussed projections 88 disposed within latching groove 56 which enables the coaxial connector to be utilized for high radio frequency applications. Bell mouth 58, tapered surface 104, and radiussed projections 88 enable the connector members 12 and 14 to be mated with smaller insertion forces than extraction forces required to disconnect them. If desired, the outer end of jack connector member 14 can be configured to be crimpably connected onto center and outer conductors of a miniature coaxial cable in a similar manner to that of plug connector member 12.

We claim:

1. A coaxial connector, comprising:

matable plug and jack connector members;

said plug connector member including an inner shell member, an outer shell member and a dielectric member carrying a center contact member, said inner shell member having a large diameter section and a small diameter section, said dielectric member being secured within said large diameter section, said center contact member having a bore to receive an exposed end of a center conductor of a coaxial cable therein while an exposed outer conductor of the coaxial cable is positioned onto said small diameter section, said center contact member being crimpable onto the center conductor end, said outer shell member having a larger diameter section and a smaller diameter section, said larger diameter section extending along said large diameter section and said smaller diameter section extending along said small diameter section and being crimpable onto said small diameter section connecting the outer conductor therebetween, said larger diameter section having a hood section including an internal latching groove, said hood section extending coaxially with respect to a pin contact section of said center contact member;

said jack connector member including a shell means and a dielectric means carrying a center contact means, said shell means having bore means in which cylindrical section means of said dielectric means is disposed and secured therein, spring contact members extending outwardly from said shell means and being spaced from and coaxial with respect to said dielectric means as they extend therealong, free ends of said spring contact members having radiussed projections, said dielectric means having a passageway therethrough in which a receptacle section of said center contact means is secured;

said center contact member of the plug connector member extends along said passageway of said dielectric means so that said pin contact section electrically connects with said receptacle section and said radiussed projections of said spring contact members of the jack connector member are disposed in said internal latching groove forming an electrical connection therebetween and latching said plug and jack connector members when mated with each other.

2. A coaxial connector as set forth in claim 1, wherein said shell means has a securing section including a serrated surface to be disposed in a hole in a ground plane making electrical and mechanical connection therewith and a flange to limit movement of the securing section in the hole.

3. A coaxial connector as set forth in claim 1, wherein said dielectric means has an annular flange at a front end, said annular flange including a tapered surface to guide the mating of the plug and jack connector members.

4. A coaxial connector as set forth in claim 1, wherein said smaller diameter section of said outer shell member will extend along a portion of an outer insulating jacket of the coaxial cable when the smaller diameter section is crimped onto said small diameter section of said inner shell member to provide a strain relief for the coaxial cable.

5. A coaxial connector as set forth in claim 1, wherein said shell means has an inwardly-directed flange means disposed in groove means in said dielectric means securing said dielectric means in said shell means.

* * * * *